US006629791B2

(12) United States Patent
Penzo

(10) Patent No.: US 6,629,791 B2
(45) Date of Patent: Oct. 7, 2003

(54) THERMAL INK RIBBON TRACTION DEVICE

(76) Inventor: Mirko Penzo, Cl. Pont,-22 Saint Just Desvern, 08960 Barcelona (ES)

( * ) Notice: Subject to any disclaimer, the term of this patent is extended or adjusted under 35 U.S.C. 154(b) by 0 days.

(21) Appl. No.: 09/979,975

(22) PCT Filed: Mar. 27, 2001

(86) PCT No.: PCT/ES01/00120

§ 371 (c)(1),
(2), (4) Date: Apr. 9, 2002

(87) PCT Pub. No.: WO01/72103

PCT Pub. Date: Oct. 4, 2001

(65) Prior Publication Data

US 2002/0176729 A1 Nov. 28, 2002

(51) Int. Cl.[7] ..... B41J 33/24
(52) U.S. Cl. ..... 400/234; 400/223; 347/217
(58) Field of Search ..... 400/120.01, 223, 400/234, 208; 347/172, 217

(56) References Cited

U.S. PATENT DOCUMENTS 4,350,454 A * 9/1982 Schoenlein ..... 400/234
5,284,396 A 2/1994 Masumura et al.
5,533,819 A 7/1996 Watanabe et al.
5,873,662 A * 2/1999 Clevinger ..... 400/234
5,906,444 A 5/1999 Jorgensen
5,975,777 A * 11/1999 Nelson et al. ..... 400/223
5,993,092 A * 11/1999 Palmer ..... 400/234
6,307,583 B1 * 10/2001 Randolph et al. ..... 347/217

FOREIGN PATENT DOCUMENTS

EP 0861735 9/1998

* cited by examiner

*Primary Examiner*—Andrew H. Hirshfeld
*Assistant Examiner*—Dave A. Ghatt
(74) *Attorney, Agent, or Firm*—Lowe Hauptman Gilman & Berner, LLP

(57) ABSTRACT

A traction device has an origin cylinder (1) of heat-sensitive ink ribbon (2), a rewinding cylinder (5), traction means and a marking header. The device prevents unused segments of ribbon being left between markings. The device has a moving support (6) guiding the ribbon (2) along an additional path (16), braking means (10, 11, 12, 14) for the origin cylinder (1). When the ribbon (2) is tractioned and the origin cylinder is braked, the support (6) is forced to move against the action of an elastic element (13), reducing the additional path (16). Thus, after a marking (a-b) the ribbon and the support (6) move back so that the next marking (b-d) is made immediately after the first marking (a-b). The braking means, after one or more markings, are released, unrolling a length of ribbon (2) from the origin cylinder, then braking again, with the process repeated.

8 Claims, 2 Drawing Sheets

THERMAL INK RIBBON TRACTION DEVICE

OBJECT OF THE INVENTION

The invention relates to a traction device for heat-sensitive ink ribbons as those used for marking surfaces, of the type which allow to fully employ the heat-sensitive ink ribbon, as currently devices are available in which unused ribbon segments are left between one marking and another. For this purpose the invention intends to use these segments by rewinding the ribbon using a simple and inexpensive device.

The invention is applicable to any type of marking with heat-sensitive ink ribbons, such as in marking plastic film with barcodes or other types of data.

BACKGROUND OF THE INVENTION

There exist in the present state of the art well-known devices for traction of heat-sensitive ink ribbon which comprise a cylinder of origin of the heat-sensitive ink ribbon which is guided by small rollers to a rewinding cylinder, which is related to a traction mechanism. In the path of the ribbon is provided at least one marking head, so that between markings as the ribbon advances there is a segment of ribbon left unused.

These type of devices have the disadvantage of wasting a large amount of heat-sensitive ink ribbon.

To solve this drawback a system is known which allows to rewind the ribbon so that marking is allowed using the ribbon segments which run between markings, for which means are provided which allow the rewinding cylinder to rotate in the sense opposite the advance sense. These means include two shafts, each related to a motor, which drive the ribbon when the rewinding cylinder is turned in said opposite sense, thereby allowing the ribbon to move backwards. This system requires to install additional motors and a precise electronic control, so that it is a sophisticated system with a high cost.

DESCRIPTION OF THE INVENTION

To achieve the aforementioned objectives the invention has developed a novel traction device for heat-sensitive ink ribbon which allows to use the entire ribbon, by means of a simple and inexpensive device.

With this purpose the device of the invention includes novel means for rewinding and tensioning the ribbon, characterised in that they include a moving support provided with guiding means for the ribbon, so that the ribbon executes an additional motion. In addition means are provided which brake the cylinder of origin so that when the ribbon is driven in the forward direction with the origin cylinder braked, the ribbon makes the support advance against the action of an elastic element which complements said support, thereby reducing the additional path traveled by the ribbon, so that after marking the driving means force a backwards motion of the ribbon. This backwards motion implies that the support moves back under the action of the elastic element, to place the marking head in a segment prior to the end of the marking already performed, equivalent to the space traveled by the ribbon during the time taken by the header to descend when making another mark. Thus, when this new mark is made the header will meet the ribbon just after the last marking performed, so that the entire ribbon is used in the marking.

In this manner the forwards-backwards motion of the ribbon does not affect in any way the cylinder of origin, which remains braked, thus greatly simplifying the forwards-backwards motion of the ribbon.

The braking means for the origin cylinder are driven by the moving support, so that after performing one or several markings with the corresponding advances and returns the support will release the braking means, to unroll a length of ribbon as requested by the traction means in a forward direction.

The braking means of the cylinder of origin acts when the moving support reaches a set advance position in which in contacts said braking means and these release the cylinder of origin. Thus while maintaining the advance of the traction means, the ribbon is unrolled by successive brakings-releases of the origin cylinder. Afterwards the traction rotation is inverted making the support return due to the action of the spring, so that the origin cylinder is again locked.

The entire process is repeated successively, and all while maintaining the ribbon tense by means of the elastic element which aids the moving support.

In order to attain this functionality the braking means of the origin cylinder are determined by a swivelling lever aided by a spring provided with a shoe, so that the spring keeps the shoe presses against the shaft of the origin cylinder.

The lever is placed in the path of the support, so that when the support contacts with it the lever swivels against the action of the spring, causing the release of the origin cylinder. This situation allows unwinding of the origin cylinder when the ribbon is tractioned.

The elastic element which complements the support is a spring. Said support is retained in guides in which it slides during its forward and backward motion.

Additionally, a stop is provided which limits the run of the support during its backwards motion, in order to ensure the correct operation of the device.

The guide means for the ribbon provided in the support consist of a cylinder which aids the advance and return of the ribbon.

These and further characteristics of the invention will be made apparent in view of the accompanying drawings, where for purposes of illustration only the following is shown.

BRIEF DECRIPTION OF THE DRAWINGS

DESCRIPTION OF A PREFERRED EMBODIMENT

Figure 1:
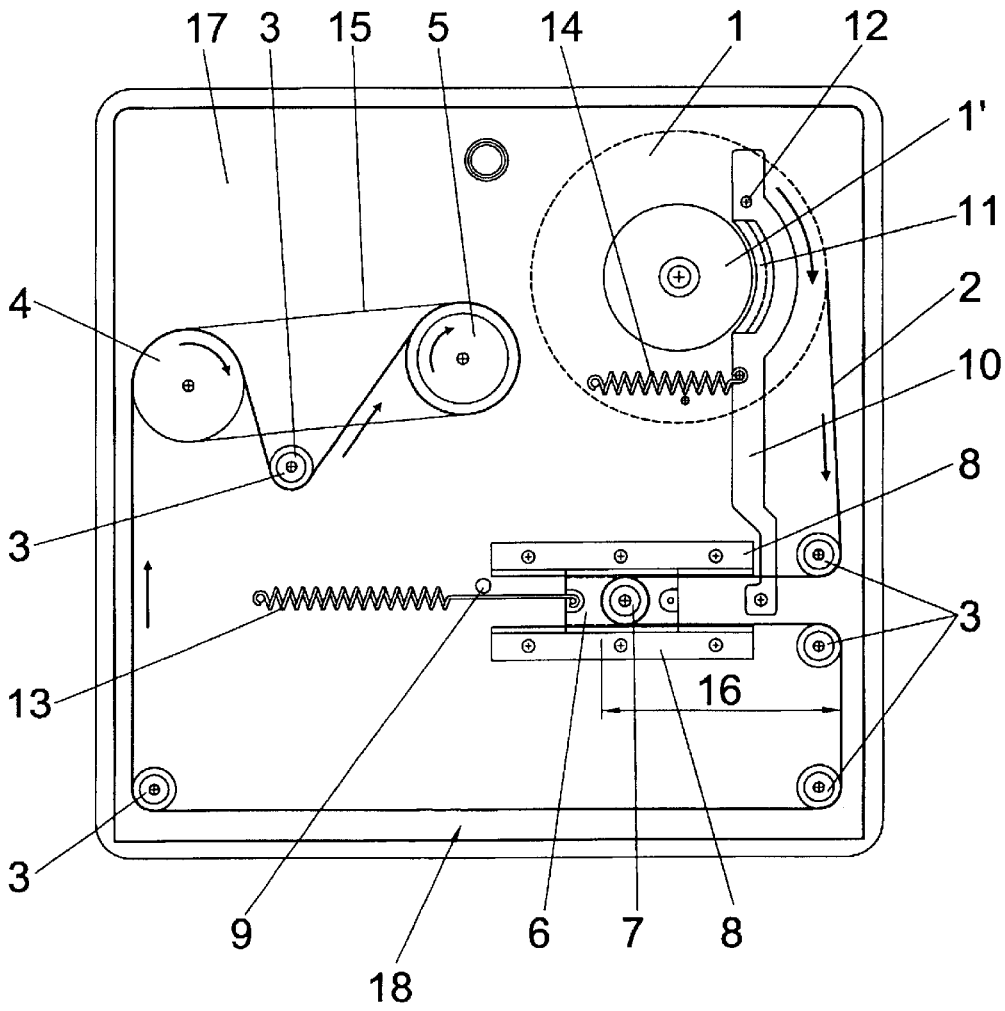
FIG. 1 shows an elevation view of an embodiment for the traction device for heat sensitive ink ribbon of the invention, in which the origin cylinder is represented in a discontinuous line to reveal the entire braking mechanism of the shaft of said cylinder.

A description of the invention follows with reference to the figures described above.

The traction device of the invention comprises a removable frame (17) mounted on a machine with heat sensitive marking devices which require heat-sensitive ribbon for said marking process.

In removable frame (17) is included an origin cylinder (1) which carries the heat-sensitive ink ribbon (2), which is guided by rollers (3) to a traction cylinder (4) which is related by a transmission belt (15) to a rewinding cylinder (5).

When the removable frame (17) is mounted on the marking machine its heads are next to the lower horizontal segment (18) of the heat-sensitive ink ribbon (2) (not shown in the figure as they are an the object of the invention).

Additionally the removable frame (17) has a moving support (6) retained by guides (8) and which includes a roller (7) on which is guided the heat-sensitive ink ribbon (2), so that the latter follows an additional path (16).

The moving support (6) is complemented by a spring (13) which pulls on it so that the tension of the heat-sensitive ink ribbon (2) is always maintained.

At the rear end of the run of the moving support (6) is provided a stop (9) which limits its run.

Additionally, a lever (10) is provided which is retained by a shaft (12) and which includes a shoe (11). Lever (10) is complemented by a spring (14), so that said spring keeps the shoe (11) pressed against the shaft (1') of the origin cylinder (1), and such that an end of lever (10) is placed at the end of the advance path of the moving support (6).

Figure 2:
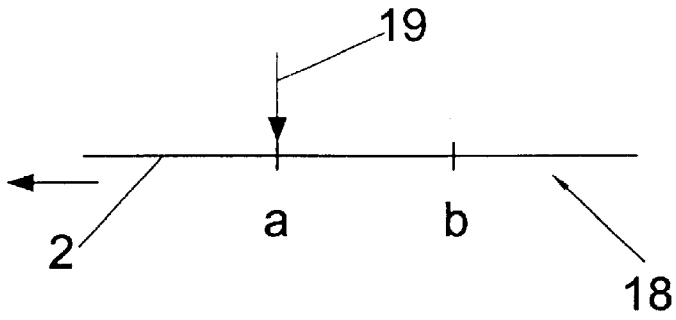
FIGS. 2 to 5 show a schematic representation of the marking process using the device of the invention.

Thus, to begin with the ribbon is mounted so that the el moving support (6) is in contact with stop (9) so that the origin cylinder (1) is braked. Marking is performed by placing head (19) on point (a) (FIG. 2) while the cylinder (4) causes the advance of the heat-sensitive ink ribbon (2), which pulls on the moving support (6), which overcomes the resistance of the spring (13) and moves along the guides (8), reducing the additional path (16).

Figure 3:
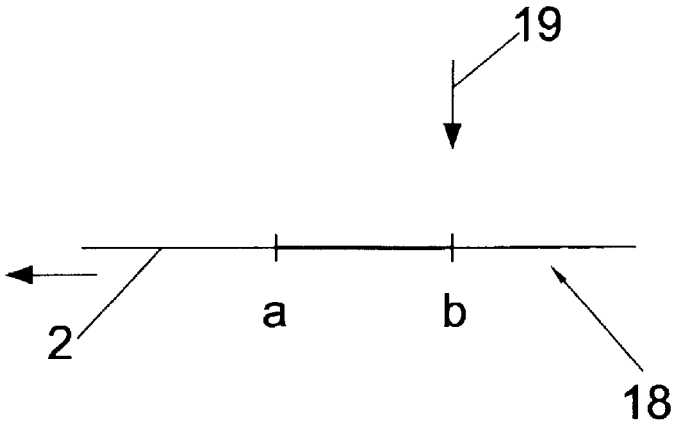
Figure 4:
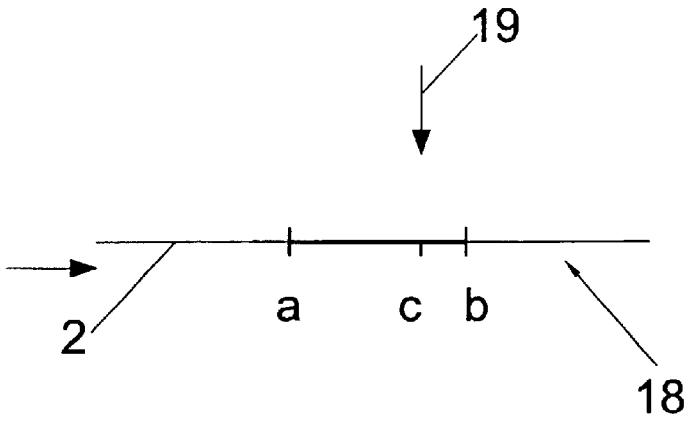
Figure 5:
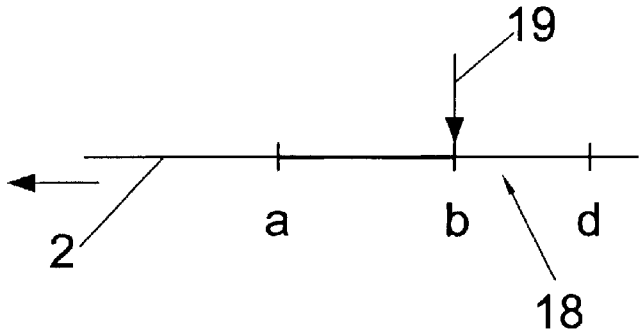

During the advance of the ribbon the marking takes place (a-b) (FIG. 3). Afterwards the rotation of the cylinder (4) is inverted, while maintaining the origin cylinder (1) braked so that as the support (13) is pulling on the support (6) the ribbon is forced to return until the header is placed at point (c). The distance (c-b) corresponds to the distance advanced by the ribbon in the time required for the header to descend and contact the said ribbon (2).

Therefore, after the header is located on point (c) a new marking takes place, with the advance of the ribbon and the descent of the header (19), which contacts the ribbon at point (b), exactly where the previous marking ended, at which point begins the marking (b-d).

This process is repeated to perform successive markings, so that there are no unused segments of ribbon between markings.

During the process described the moving support (6) runs from the position where it is in contact with stop (9) until it presses on lever (10), which lever is jointed to shaft (12), causing the release of shaft (1') of the origin cylinder (1). Thus the ribbon is unrolled in an amount required by the traction. Since the origin cylinder is braked again as soon as the moving support (6) stops pressing on the lever (10), to unroll the required length of ribbon the traction must act in the advance direction, with consecutive brakings-releases of the origin cylinder until the required ribbon is unrolled. Said brakings-releases occur so quickly that they can hardly be appreciated by the eye. After the required length of ribbon is unrolled the traction rotation direction is inverted so that the moving support (6) travels back towards the stop (9) as far as determined by the action of the spring (13), all such that the ribbon tension is maintained. In addition, during this return motion of the support (6) it stops acting on the lever (10), so that by action of the spring (14) the shoe (11) again contacts the shaft (1') of the origin cylinder (1), again causing the braking of said cylinder (1). The several brakings are attained quite efficiently as the inertia of the cylinder (1) during its unrolling is small.

It should be remarked that for high marking speeds the cylinder inertia is a significant parameter, as if it acquires a high inertia braking is hindered and thus the precision of the device is reduced.

The above described process is repeated sequentially until exhausting the heat-sensitive ink ribbon (2) wound on cylinder (1).

Therefore, the device of the invention allows to fully use the ribbon by means of a simple, precise and inexpensive mechanism.

What is claimed is:

1. Traction device for heat-sensitive ink ribbon, said device comprising:

an origin cylinder (1) for the heat-sensitive ink ribbon (2);

traction means;

a rewinding cylinder (5) which is mechanically associated with said traction means;

a plurality of rollers (3) for guiding the ribbon (2) towards said rewinding cylinder;

at least one marking header positioned along a path of the ribbon (2), and adapted to form markings on the ribbon (2) with rising and lowering of the header and advance of the ribbon (2);

returning and tensioning means for returning and tensioning the ribbon (2) and allowing the markings to be made on said ribbon without unused segments of said ribbons being left between the markings, wherein the returning and tensioning means comprise an elastic element (13) and a moving support (6) which is provided with guiding means for guiding the ribbon (2) so that the ribbon follows an additional motion (16); and braking means (10, 11, 12, 14) for braking the origin cylinder (1) so that as the ribbon (2) advances, the moving support (6) is forced to advance against action of said elastic element (13) which complements said moving support (6), thereby reducing the additional motion (16) of the ribbon (2);

wherein after a first marking (a-b) has been made in a segment of said ribbon, the traction means move the ribbon backwards, together with the support (6) by action of the elastic element (13), to place the segment of said ribbon (a-b) under the header at a point (c) so that when the ribbon again advances to perform a second marking (b-d), the second marking is performed just after the first marking (a-b);

the braking means are actuated by the moving support so that after a predetermined number of markings are performed, the support releases the braking means, unrolling a required length of said ribbon; and the ribbon (2) is maintained tense at all times.

2. Traction device for heat-sensitive ink ribbon as claimed in claim 1, wherein the braking means is actuated when the moving support (6) reaches a certain advance position where the moving support contacts the braking means; and the braking means, when actuated, release the origin cylinder (1) so that the traction means, in a forward direction, unwind the ribbon (2) and then return, by the action of the elastic element (13), from the advance position until the braking means again brake the origin cylinder (1).

3. Traction device for heat-sensitive ink ribbon as claimed in claim 2, further comprising a stop (9) which limits the motion of the moving support in a return path.

4. Traction device for heat-sensitive ink ribbon as claimed in claim 1, wherein the braking means consist of a swiveling lever (10) provided with a shoe (11) and a spring (14) which keeps the shoe (11) pressed against a shaft (1') of the origin cylinder (1).

5. Traction device for heat-sensitive ink ribbon as claimed in claim 4, wherein the swiveling lever (10) is placed in a path of the moving support (6), such that, when said moving support contacts the lever, the lever swivels, overcoming the action of the spring (14) and separating the shoe (11) from the shaft (1') of the origin cylinder (1); and when the lever (10) is no longer acted upon by said moving support, the spring (14) again forces the shoe (11) to brake the origin cylinder.

6. Traction device for heat-sensitive ink ribbon as claimed in claim 1, wherein the elastic element which complements the moving support (6) is a spring (13).

7. Traction device for heat-sensitive ink ribbon as claimed in claim 1, wherein the moving support (6) is slidably retained by guides (8).

8. Traction device for heat-sensitive ink ribbon as claimed in claim 1, wherein the guiding means of the moving support are embodied in a roller (7).

* * * * *